United States Patent [19]

Milde et al.

[11] 4,132,285

[45] Jan. 2, 1979

[54] CONNECTING LINE WITHIN AN EXHAUST SYSTEM OF A MOTOR VEHICLE

[75] Inventors: Wilhelm Milde; Gerhard Hoheisel, both of Wolfsburg, Germany

[73] Assignee: Volkswagenwerk Aktiengesellschaft, Wolfsburg, Germany

[21] Appl. No.: 704,042

[22] Filed: Jul. 8, 1976

[30] Foreign Application Priority Data

Jul. 10, 1975 [DE] Fed. Rep. of Germany ..... 2530800

[51] Int. Cl.[2] ..... F01N 1/04; F01N 3/06; F01N 7/18; F16L 11/00

[52] U.S. Cl. ..... 181/258; 138/120; 138/157; 181/227; 181/228; 181/240; 181/252; 181/282

[58] Field of Search ..... 181/36 C, 61, 69, 62, 181/42, 46, 35 B, 35 R, 208, 228, 227, 240, 247, 252, 258, 282; 138/119, 157, DIG. 8, 11, 117, 120, 155, 163; 285/9, 62

[56] References Cited

U.S. PATENT DOCUMENTS

| | | | |
|---|---|---|---|
| D. 200,530 | 3/1965 | Jettinghoff | 181/61 |
| 1,638,428 | 8/1927 | Zander | 138/157 |
| 2,157,564 | 5/1939 | Peuthert | 181/36 B |
| 2,262,627 | 11/1941 | Whitesell, Jr. et al. | 138/157 |
| 2,484,827 | 10/1949 | Harley | 181/61 |
| 2,499,018 | 2/1950 | Christiano et al. | 181/258 |
| 2,713,195 | 7/1955 | Hemmer | 181/61 |
| 2,888,001 | 5/1959 | Morrish | 181/35 B |
| 2,902,109 | 9/1959 | Burgess et al. | 181/61 |
| 3,158,222 | 11/1964 | Richmond | 181/61 |
| 3,295,556 | 1/1967 | Gertsma et al. | 138/119 |
| 3,470,690 | 10/1969 | Thompson | 181/46 |
| 3,488,723 | 1/1970 | Veazie | 181/62 |
| 3,655,010 | 4/1972 | DuBois | 181/36 B |

FOREIGN PATENT DOCUMENTS

| | | | |
|---|---|---|---|
| 1005319 | 5/1958 | Fed. Rep. of Germany | 181/36 B |
| 1924298 | 5/1969 | Fed. Rep. of Germany | 181/62 |
| 2256718 | 11/1972 | Fed. Rep. of Germany | 181/36 B |
| 1174509 | 11/1958 | France | 181/61 |

*Primary Examiner*—Stephen J. Tomsky
*Attorney, Agent, or Firm*—Spencer & Kaye

[57] ABSTRACT

A connecting line or exhaust pipe for disposal within the exhaust system of a motor vehicle driven by an internal-combustion engine between the exhaust manifold of the engine and the muffler. The connecting line is formed of two bowl-shaped sheet metal half-shells which are preshaped, e.g., by pressing, deep drawing or the like, and which are superposed on one another, and firmly connected together. The half-shells of the connecting line have a shape such that the connecting line has a non-circular substantially flat cross section with respect to its vertical dimension when the connecting line is connected in the vehicle exhaust system.

7 Claims, 8 Drawing Figures

II
III
1
2
4
5
6
7
8

CONNECTING LINE WITHIN AN EXHAUST SYSTEM OF A MOTOR VEHICLE

BACKGROUND OF THE INVENTION

The present invention relates to a connecting line or pipe, which is disposed in the exhaust system of a motor vehicle driven by an internal combustion engine, for providing the connection between the exhaust manifold and the muffler.

In motor vehicles with front-wheel drive and transversely arranged engines, the rotary movement of the engine about its longitudinal axis, which rotary movement is produced mainly by the driving moment, is particularly strong. This rotary movement of the engine is initiated by the exhaust system of the motor vehicle. Unless it is reduced by the elasticity of the exhaust line, the rotary moment results in a significant deflection of the tailpipe. Since the required clearance from the chassis of the motor vehicle would no longer be assured if the tailpipe were deflected too much, such deflection must be limited. Since with rigid clamping of the exhaust system considerable bending stresses would occur therein, which stresses would lead to breaks at least over the course of time, it is necessary to at least provide individual regions of the exhaust system with an elastic configuration.

It is known therefore, (e.g. see German Pat. No. 1,005,319, issued May 14th, 1958) to build joints into the exhaust line so as to assure the desired elasticity. However, in that case movable seals must also be provided which, due to the prevalent high temperatures, are greatly subject to wear. It is also known (e.g. German Offenlegungsschrift No. 2,256,718, published May 22nd, 1974) to include a corrugated pipe in the exhaust line which has a specially dimensioned wall thickness. When such a corrugated pipe is used, the above-mentioned difficulties are completely eliminated but the cost for the manufacture of such corrugated pipes is considerable.

SUMMARY OF THE INVENTON

It is therefore the object of the present invention to provide a connecting line or pipe of the above-mentioned type which has the required stability over longer periods of use at the occurring high temperatures as well as the required elasticity to sufficiently compensate the rotary movement of the motor about its longitudinal axis, and which is economical to manufacture.

This is accomplished according to the present invention in that the connecting line has a substantially flat cross section with respect to its vertical dimension when connected in the exhaust system and is comprised of two sheet-metal half-shells which have been preshaped, e.g., by pressing, deep drawing or the like, and which are connected in a superposed arrangement. Preferably the cross section is at least approximately oval.

It is known (German Offenlegungsschrift No. 1,924,298, published July 2nd, 1970) to produce parts of an exhaust system in which two preshaped sheet-metal halves are superposed and welded together at their folded edges. These parts, however, are always only relatively short pieces, i.e., either mufflers of the conventional type or somewhat more complicated line branching structures in the form of Y pipes which obviously have the customary circular cross section. In contradistinction thereto, the connecting line according to the invention is a comparably long structure which intentionally also includes such line sections which, contrary to the above-mentioned line branching sections of the known exhaust systems, have an uncomplicated shape.

Compared to the generally used connecting lines with circular cross sections, the connecting line according to the invention has such a high bending elasticity, due to its comparably low bending resistance moment about the transverse axis of the vehicle, that the rotary movement introduced by the engine into the exhaust system is absorbed without adverse influence on the system. Moreover, the connecting line according to the invention has the significant advantage that it can be produced considerably easier than a corrugated pipe with similar good properties. It can also be better matched to the existing conditions because its cross section can be made variable more easily and economically along its longitudinal extent. These advantages become particularly evident if the connecting line, according to an advantageous embodiment of the invention, is provided with two line sections which blend into one another in the longitudinal direction and with the section facing the exhaust manifold of the internal-combustion engine being designed as a dual or multiple pipe and the second section facing the muffler of the exhaust system being designed as a single pipe.

DETAILED DESCRIPTION OF THE PREFERRED EMBODIMENTS

Figure 3A:
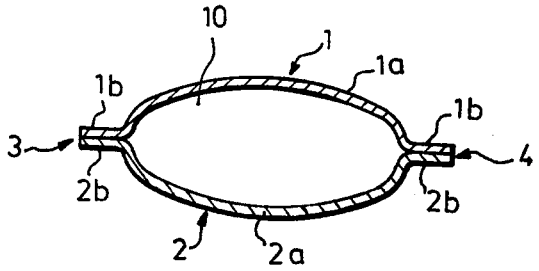
FIG. 3A is a cross-sectional view of the connecting line of FIG. 1 taken along the line 3A—3A of FIG. 3.

Referring now to the Figures there is shown a connecting line according to the invention which basically comprises two elongated preshaped sheet-metal half-shells 1 and 2 which are superposed and connected together along their length. As best shown in FIG. 3A each of the preshaped half-shells 1 and 2, which are preferably preshaped in a pressing or drawing process, has a bowl-shaped cross section with a curved central portion, e.g., 1*a*, and two laterally extending flat edge portions e.g., 1*b*. When the two half-shells 1 and 2 are superposed, the superposed edge portions 1*b* and 2*b* form bars 3 and 4 which extend along the length of the connecting line and are substantially horizontally oriented when the connecting line is connected in the exhaust system of the vehicle. The edge portions 1*b* and 2*b* forming the bars 3 and 4 are firmly connected together by welding, and preferably in a roll welding process.

Connected to the two ends of the thus produced connecting line 1–2 by welding are flanges 5 and 6. In the illustrated embodiment a secure connection between flange 5 and the two sheet-metal half-shells 1 and 2 is assured by a special transition piece 8 which is welded on the one side to flange 5 and on the other side to the two sheet-metal half-shells 1 and 2. Flange 5 of the connecting line is connected to the exhaust manifold (not shown) of the internal-combustion engine 7 which is mounted transversely in the motor vehicle. Correspondingly, flange 6 of the connecting line is connected to the succeeding portions of the exhaust system, e.g., a muffler, a catalytic converter or a connecting line to the muffler, etc.

The combined sheet-metal half-shells 1 and 2 are designed so that a line cross section results for the connecting line which is noncircular and substantially flat with respect to the vertical dimension of the connecting line when it is connected in the exhaust system of the vehicle. In the illustrated embodiment, the cross-sectional shape of the connecting line or pipe is at least approximately oval as is best indicated schematically in FIGS. 2A and 3A at 9 or 10, respectively. It can be seen that due to its substantially flat cross section the connecting pipe will provide only slight resistance to a bending stress around the transverse axis of the motor vehicle, originating from the internal-combustion engine, as compared to a similarly connected connecting pipe having a circular cross section. This bending elasticity is sufficient to absorb the rotary movement introduced by the internal-combustion engine into the exhaust system without damage to the entire exhaust system. It is understood that the elasticity of the connecting line according to the invention depends, inter alia, also on its length and that it is greater the longer is the connecting line.

Figure 1:
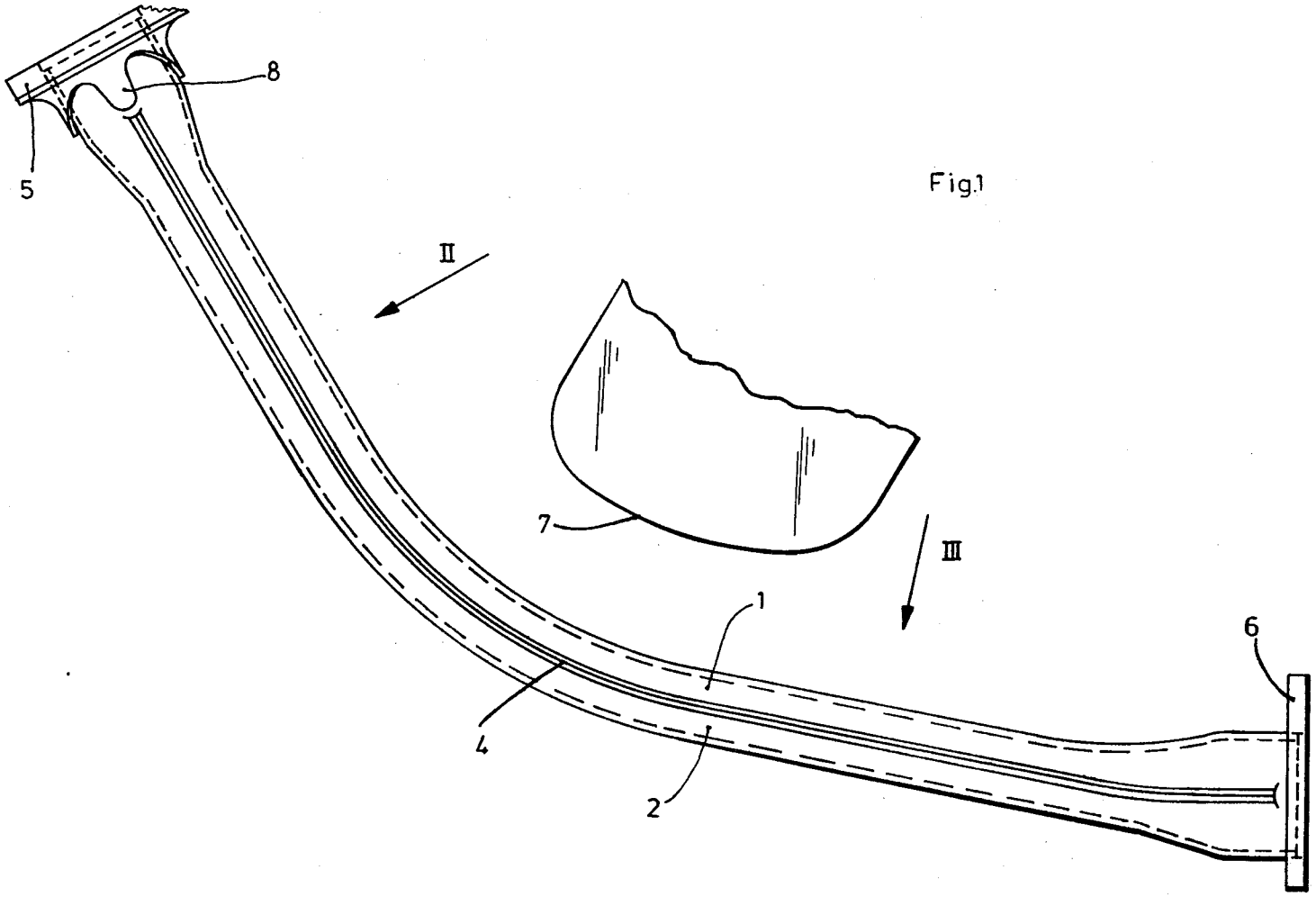
FIG. 1 is a side view of a preferred embodiment of a connecting line according to the invention.
Figure 2:
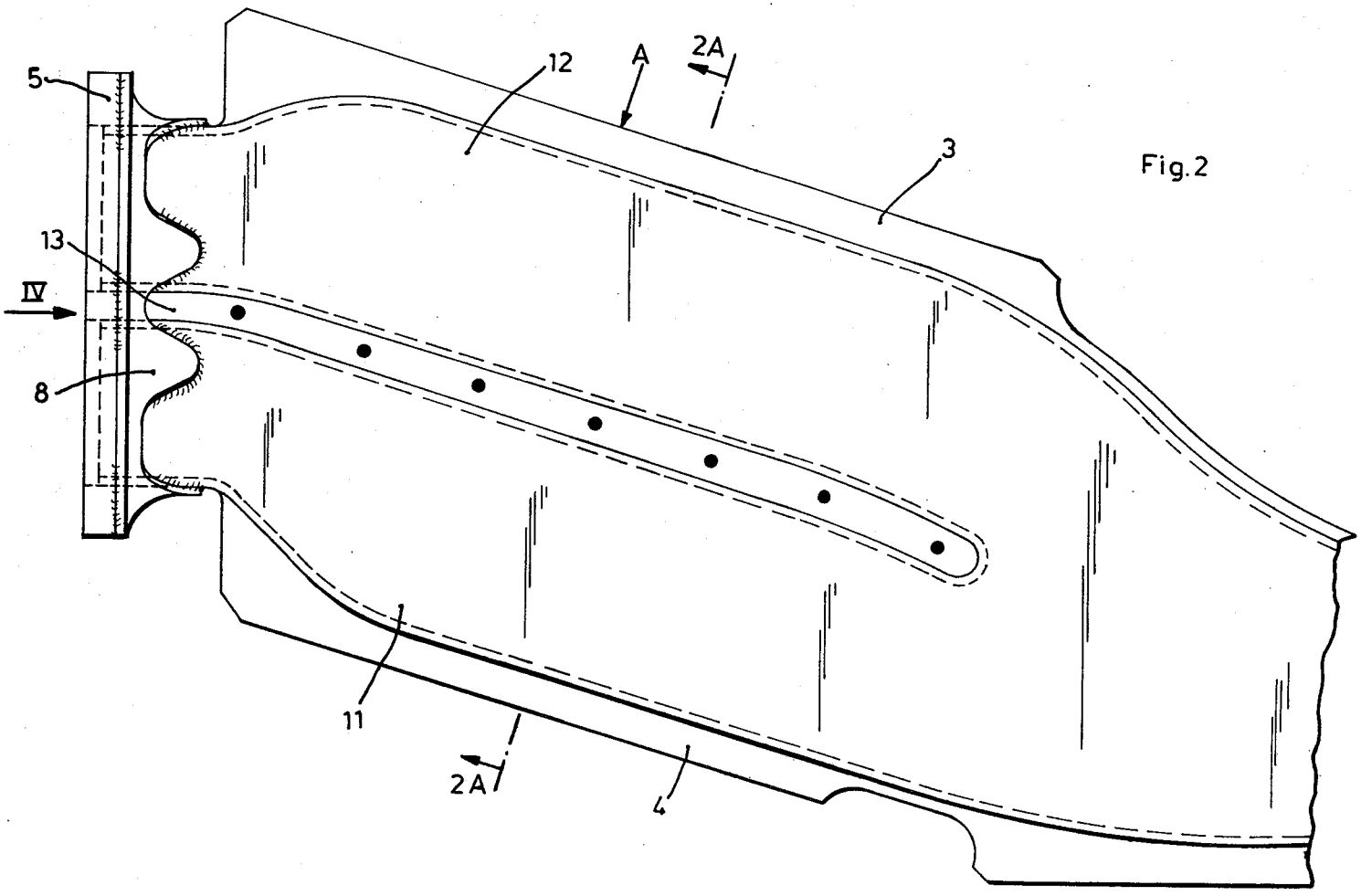
FIG. 2 is a top view of one end portion of the connecting line taken in the direction of the arrow marked II in FIG. 1.
Figure 2A:
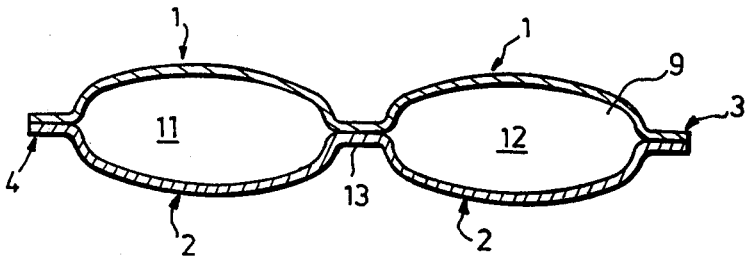
FIG. 2A is a cross-sectional view of the connecting line of FIG. 1 taken along the line 2A—2A of FIG. 2.
Figure 3:
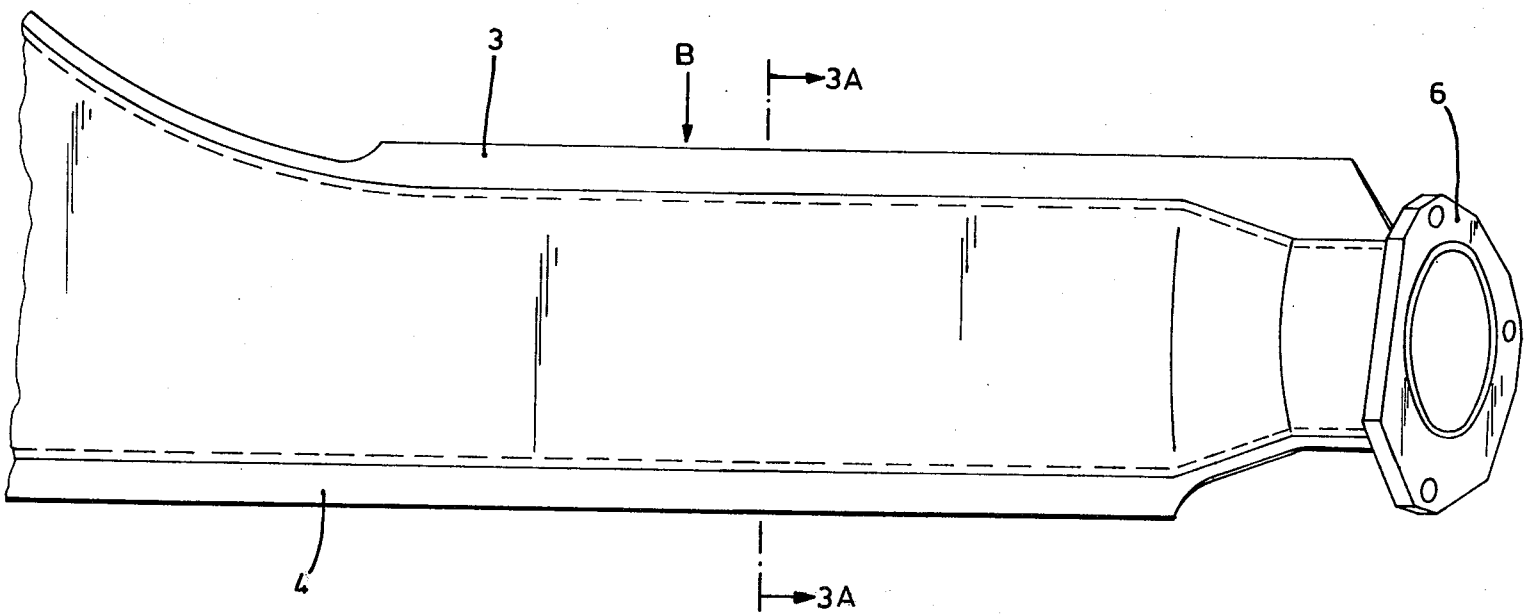
FIG. 3 is a top view of the other end portion of the connecting line taken in the direction of the arrow marked III in FIG. 1.
Figure 4:
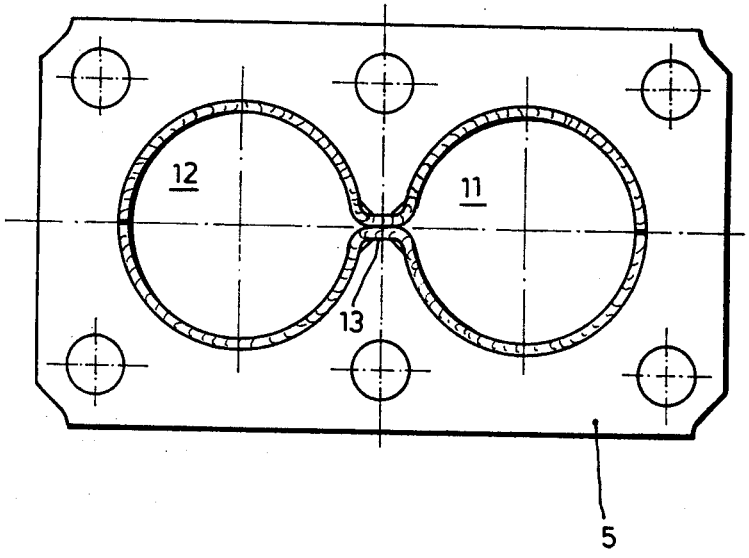
FIG. 4 is an end view of the connecting line of FIG. 1 in the direction of the arrow IV of FIG. 2.

In the illustrated embodiment the connecting line has two longitudinal portions A (FIGS. 2 and **2*a*) and B (FIGS. 3 and 3 A) which blend into one another to form a unitary structure. The first longitudinal portion A to which flange 5 is fastened and which faces the exhaust manifold of the internal-combustion engine, is provided in the form of a dual pipe with the two pipes being marked 11 and 12. The end view of the flange 5 and the two pipes 11 and 12 of portion A are shown in FIG. 4. As shown in FIGS. 2 and 2 A, the two pipes 11 and 12 are provided simply by forming the half-shells 1 and 2, in the region of the portion 1 with a pair of side-by-side bowl-shaped cross-sectional portions and by additionally welding the two half-shells 1 and 2 along the superposed portions 13. The second longitudinal portion B of the connecting line, which faces the muffler or the catalytic converter etc., of the exhaust system is provided as a single pipe to which is connected the flange 6 (FIG. 3**).

It can be seen that it would also be possible, without much additional expense, to arrange more than two pipes within the first region A of the connecting line according to the invention. It would then merely be necessary to appropriately design the two sheet-metal half-shells 1 and 2 in this area. The amount of work required, however, would remain substantially the same. It can easily be appreciated that if such a line section were to be produced of conventional pipes, a plurality thereof would have to be welded together with relatively difficult weld seam paths. The connecting line according to the invention has the significant advantage thereover that it can be adapted without difficulty to the respective requirements for its shape as well as its bending elasticity. Thus it is possible in particular — as shown in FIG. 3 — to vary the line cross section of the connecting line over the length of the connecting line.

Figure 5:
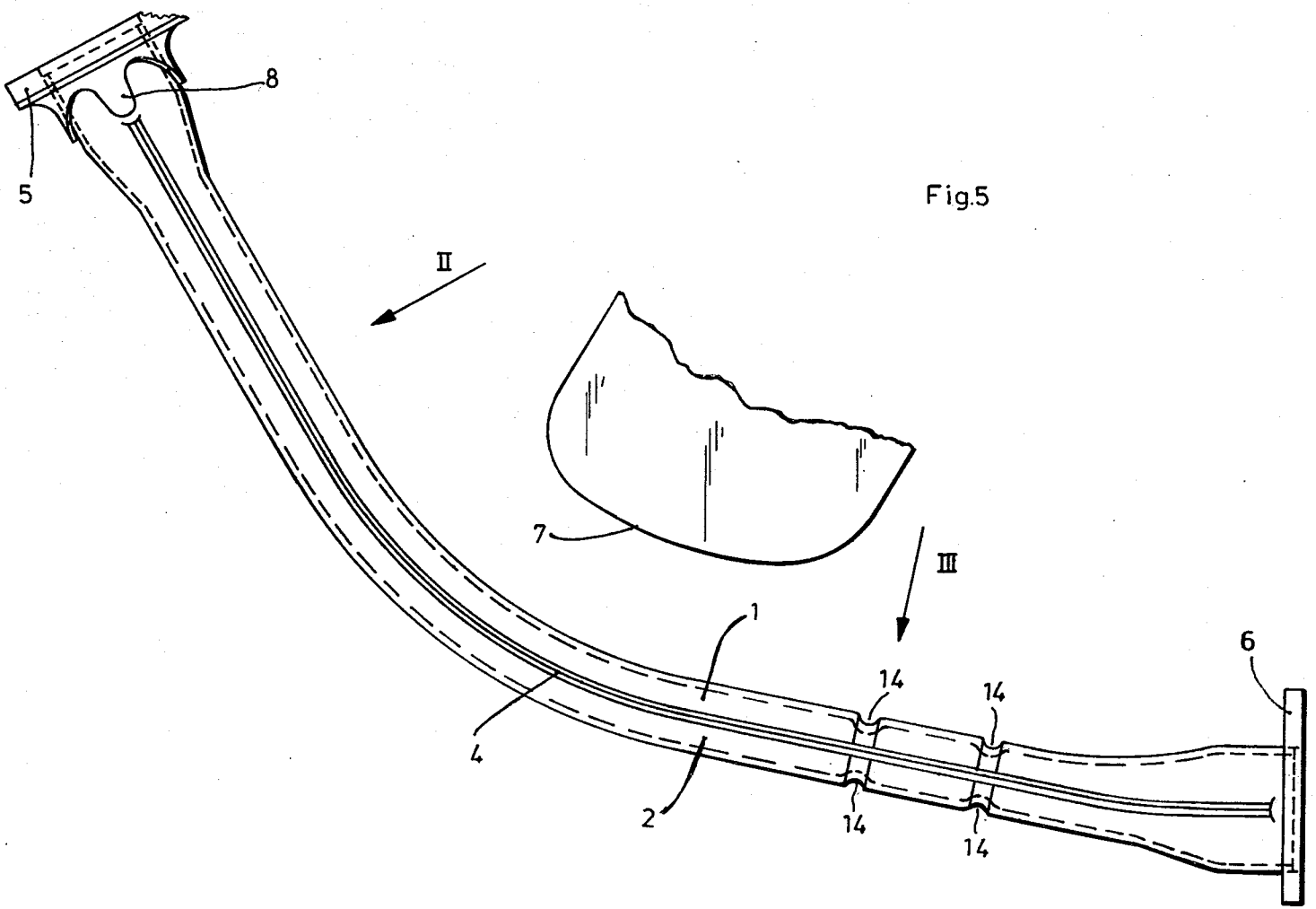
FIG. 5 is a side view of another embodiment of a connecting line according to the invention.

There also exists the possibility of providing the two sheet-metal half-shells 1 and 2 with transversely extending crimps or the like so as to produce cross-sectional constrictions over the length of the connecting line causing the exhaust gases to expand. The connecting line then simultaneously takes over, to a certain extent, the function of a preliminary muffler. The connecting line shown in FIG. 5 is provided with two such transversely extending crimps 14 spaced from oneanother.

If the muffling effect of the connecting line is to be further increased, this can be done in a simple manner in that sound insulating wool is inserted into the two sheet-metal half-shells 1 and 2 before the connecting line according to the invention is assembled.

Figure 6:
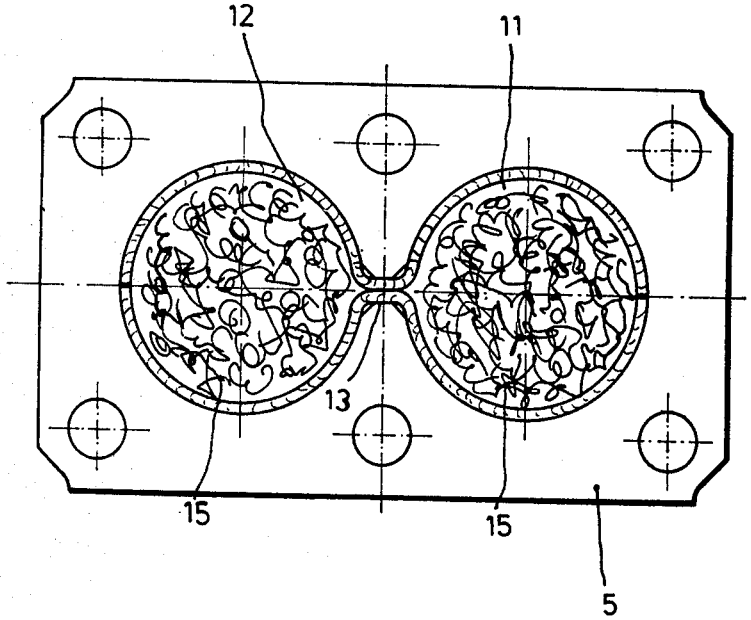
FIG. 6 is an end view similar to the end view of FIG. 4.

FIG. 6 shows the end view of such an embodiment of the invention. As can be seen the space between the two connected together sheetmetal half-shells 1 and 2 is filled up with such insulating wool 15.

It will be understood that the above description of the present invention is susceptible to various modifications, changes and adaptations, and the same are intended to be comprehended within the meaning and range of equivalents of the appended claims.

What is claimed is:

1. In a connecting line for the exhaust system of a motor vehicle driven by an internal combustion engine, said connecting line having means at one end thereof for connecting the line to the exhaust manifold of the engine and means at the other end thereof for connecting the line to the succeeding portions of the vehicle exhaust system, the improvement wherein: said connecting line has a cross section which is at least approximately oval; said cross section is oriented relative to said means at one end so that the larger dimension of said oval lies substantially horizontally when said line is connected to the exhaust manifold of the vehicle; and said connecting line comprises two preshaped elongated sheet-metal half-shells, each having a bowl-shaped cross section, which are arranged in a superposed manner and are firmly connected together.

2. A connecting line as defined in claim 1 wherein said bowl-shaped cross section of each of said half-shells includes a central curved dish portion and a laterally extending flat edge portion on each side; and wherein said laterally extending edge portions are superposed and connected together to form bars which extend along the length of said connecting line and are at least approximately horizontally oriented when said connecting line is connected in the exhaust system of the vehicle.

3. A connecting line as defined in claim 2 wherein the associated said edges of said half-shells are welded together.

4. A connecting line as defined in claim 2 wherein said cross section of said connecting line varies over the length thereof.

5. A connecting line as defined in claim 3 wherein at least one crimp which reduces the cross section of said connecting line is provided in said sheet-metal half-shells.

6. A connecting line as defined in claim 1, wherein said connecting line includes first and second longitudinal portions which blend into one another, said first portion, which is the portion to be connected to the exhaust manifold of the internal-combustion engine, including a plurality of individual pipes formed by said half-shells, and said second portion which portion faces the muffler of the exhaust system, being a single pipe.

7. A connecting line as defined in claim 1 further comprising sound insulating wool inserted into said sheet-metal half-shells before they are assembled.

* * * * *